US006186070B1

(12) United States Patent
Fong et al.

(10) Patent No.: US 6,186,070 B1
(45) Date of Patent: Feb. 13, 2001

(54) COMBINED EFFECTS WARHEADS

(75) Inventors: Richard Fong, Boonton Township; Steven Tang, South Plainfield, both of NJ (US)

(73) Assignee: The United States of America as represented by the Secretary of the Army, Washington, DC (US)

( * ) Notice: Under 35 U.S.C. 154(b), the term of this patent shall be extended for 0 days.

(21) Appl. No.: 09/208,399

(22) Filed: Nov. 27, 1998

(51) Int. Cl.[7] ..... F42B 13/12
(52) U.S. Cl. ..... 102/476
(58) Field of Search ..... 102/476, 306, 102/307, 308, 309, 310, 501, 491, 492, 493, 494, 495, 496, 497

(56) References Cited

U.S. PATENT DOCUMENTS

| | | | | |
|---|---|---|---|---|
| H540 | * | 11/1988 | Caponi | 102/495 |
| 3,750,582 | * | 8/1973 | Kintish et al. | 102/56 |
| 3,855,933 | * | 12/1974 | Messineo | 102/56 |
| 3,970,005 | * | 7/1976 | Rothman | 102/67 |
| 3,976,010 | * | 8/1976 | Zernow | 102/56 |
| 4,004,518 | * | 1/1977 | Potteiger et al. | 102/67 |
| 4,359,943 | * | 11/1982 | Majerus | 102/309 |
| 4,499,830 | * | 2/1985 | Majerus et al. | 102/476 |
| 4,590,861 | * | 5/1986 | Bugiel | 102/501 |
| 4,942,819 | * | 7/1990 | Thoma et al. | 102/476 |
| 4,974,516 | * | 12/1990 | Eyal et al. | 102/476 |
| 5,090,324 | * | 2/1992 | Bocker et al. | 102/307 |
| 5,131,329 | * | 7/1992 | Lips et al. | 102/364 |
| 5,164,538 | * | 11/1992 | McClain, III | 102/517 |
| 5,792,980 | * | 8/1998 | Weimann | 102/476 |

* cited by examiner

*Primary Examiner*—Thomas Price
(74) *Attorney, Agent, or Firm*—John F. Moran; Michael C. Sachs

(57) ABSTRACT

A combined effect warhead device for forming at least one aerostable rod fragment and a plurality of small fragments by explosive formation. The warhead is centered about an axis and contains explosives and liners. A first liner forms an aerostable rod and a second liner forms a plurality of fragments, whereby upon detonation of the warhead, combined explosively formed projectiles are produced including the aerostable rod and the plurality of fragments. In a preferred embodiment, the first liner is unscored and curved, whereas the second liner is scored to facilitate formation of the plurality of fragments. The second liner is almost flat and includes raised portions on its surface to facilitate formation of the plurality of fragments. It is also preferred to include an interface material between the first and the second liner, preferably where the interface material is a combination of explosive material and plastic. The first and second liners may be oriented side by side in the warhead, or, more preferably, in tandem in the warhead. The first liner may be axially above the second liner or the reverse. The warhead is either axisymmetric or non-axisymmetric about its axis.

16 Claims, 2 Drawing Sheets

COMBINED EFFECTS WARHEADS

COMBINED EFFECTS WARHEADS

The invention described herein may be manufactured, used, and licensed by or for the U.S. Government for U.S. Governmental purposes.

FIELD OF THE INVENTION

The present invention relates to munitions for penetration of targets. More particularly the invention relates to munitions that are designed to penetrate a broad spectrum of armored and unarmored vehicle targets.

BACKGROUND OF THE INVENTION

The modern battlefield is likely to contain a broad spectrum of armored and unarmored vehicle targets. The penetration required to inflict lethal damage to the targets ranges from fractions of an inch for trucks to several inches for armored vehicles. Current munitions carry warheads that are specifically designed to either provide deep penetration of heavy armor or multiple fragments for wide area coverage.

Some armored vehicles such as tanks and the like carry sufficient armor so that the required penetration of several inches of armor is only achieved by relatively long, monolithic rods. However, rocket launchers, trucks, and lighter armored gun carrying vehicles may be defeated by penetration of only a fraction of an inch. Since there is only so much material in a warhead, it is not practical to attempt to defeat light armor and no armor vehicles with warheads that produce heavy armor piercing fragments, and, clearly, the multiple fragment warheads aren't any danger to heavy armored tanks and the like.

Presently available are warheads with single explosively formed penetrator forming liners. Also, warheads have been designed with multiple explosively formed penetrator forming liners. However, there has been no effort to provide a combination liner that would produce both at one time.

It would be of great advantage if a family of warhead concepts could be developed which combine both features, of deep penetration by larger fragments along with multiple fragments for wider coverage, in one single warhead.

Accordingly, one object of this invention is to provide a multiple size fragmenting warhead for use with a wide range of targets.

Another object of this invention is to provide a warhead capable of defeating a wide spectrum of targets.

A specific object of this invention is to provide a warhead that produces both a long rod explosively formed penetrator and multiple explosively formed penetrators in once device.

Other objects will appear hereinafter.

SUMMARY OF THE INVENTION

It has now been discovered that the above and other objects of the present invention may be accomplished in the following manner. Specifically, the present invention is a combined effect warhead device for forming at least one aerostable rod fragment and a plurality of small fragments by explosive formation.

The warhead is centered about an axis and contains explosives and liners. It may be either axisymmetric or non-axisymmetric about its axis, depending upon the type of munition deploying device such as a cannon or the like is used to deliver the warhead. Typically, warheads of the present invention are to be used with conventional munitions. It is known to have warheads that produce aerostable rod and it is similarly known to have warheads that produce the plurality of fragments in present day munitions. Either munition may be used with the novel warheads of this invention.

The first liner forms an aerostable rod, whereby upon detonation of the warhead, explosively formed projectiles are produced including the aerostable rod for defeat of armored vehicles and the like. In a preferred embodiment, the first liner is unscored and curved, as these conditions have been found to produce the desired rod shape.

The second liner forms a plurality of fragments, whereby upon detonation of the warhead, a multiplicity of explosively formed projectiles are produced for defeat of trucks, light armored vehicles and the like. The second liner is scored to facilitate formation of the plurality of fragments. The second liner is almost flat and includes raised portions on its surface to facilitate formation of the plurality of fragments.

In some embodiments, it is desirable to include an interface material between the first and the second liner. Preferred materials include interface materials such as grease, plastics such as lexan, and combinations of explosive material and plastic.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
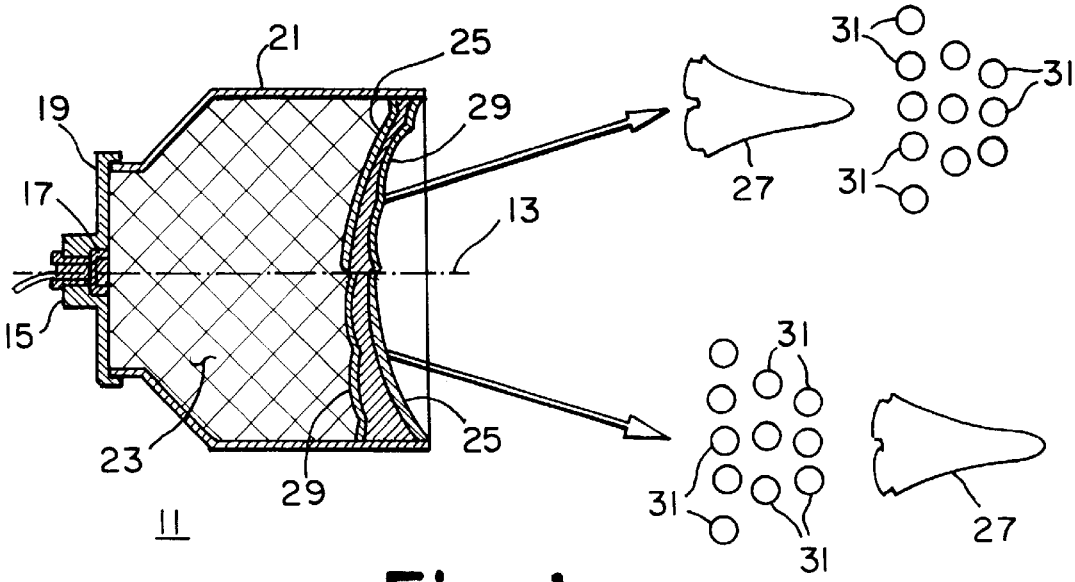
FIG. 1 is a schematic view of an axisymmetric device in accordance with the invention.
Figure 2:
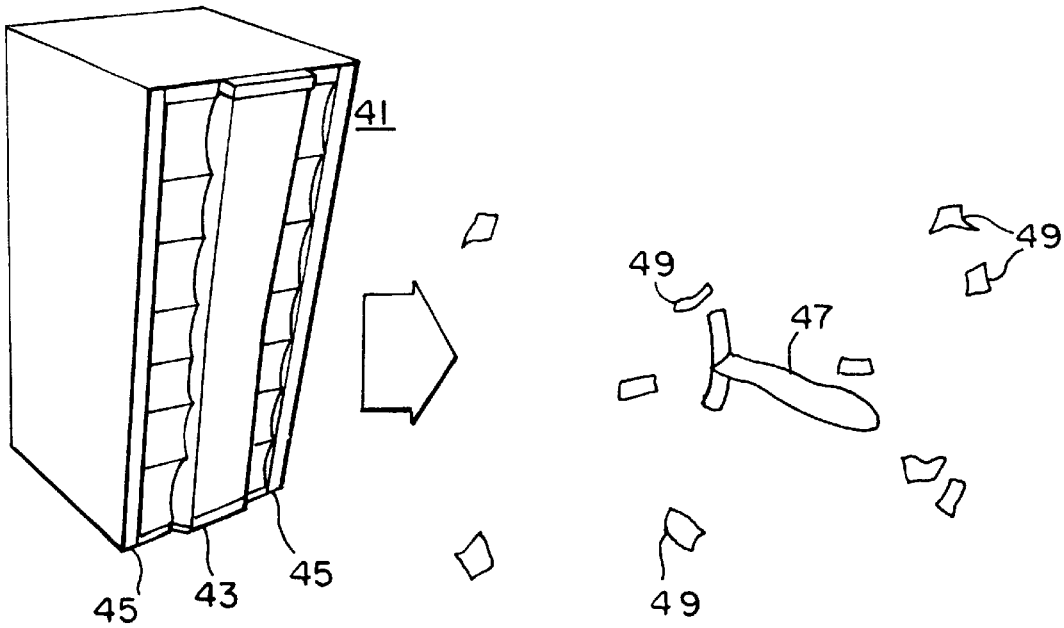
FIG. 2 is a schematic view of an non-axisymmetric device in accordance with the invention.

The present invention has many advantages over the prior art. Referring to FIG. 1, the present invention comprises a combined effect warhead 11, whereas an alternative embodiment is shown in FIG. 2, described herein below. Warhead 11 is known as an axisymmetrical combined effect warhead, centered about axis 13.

Warhead 11 includes a detonator 15 (with an adapter) and a booster 17 affixed to a back plate 19 (made from plastic in this embodiment). The case 21 (in this embodiment made from aluminum) contains the explosive 23, which may be any explosive used in present or future day munitions.

The front of warhead 11 in FIG. 1 is shown in two embodiments to illustrate some of the several configurations of the present invention. The top portion of warhead 11 includes a first liner 25 which forms an aerostable rod 27 upon detonation. A second liner 29 is axially forward of liner 25 and is adapted to form a plurality of fragments 31. In actual use, liners 25 and 27 would cover the entire diameter of warhead 11, but are shown covering one half to illustrate several alternative embodiments. The bottom half of warhead 11 shows second liner 29 in proximate contact with explosive 23 while first liner 25 is axially forward of liner 29. In this configuration, the aerostable rod 27 is forward axially of the plurality of fragments 31.

FIG. 1 also illustrates a warhead in which a first liner might be adjacent to the second liner, so that half, for example, of the warhead would produce aerostable rod 27 and half would produce the plurality of fragments 31, each liner being side by side with the other.

Figure 3:
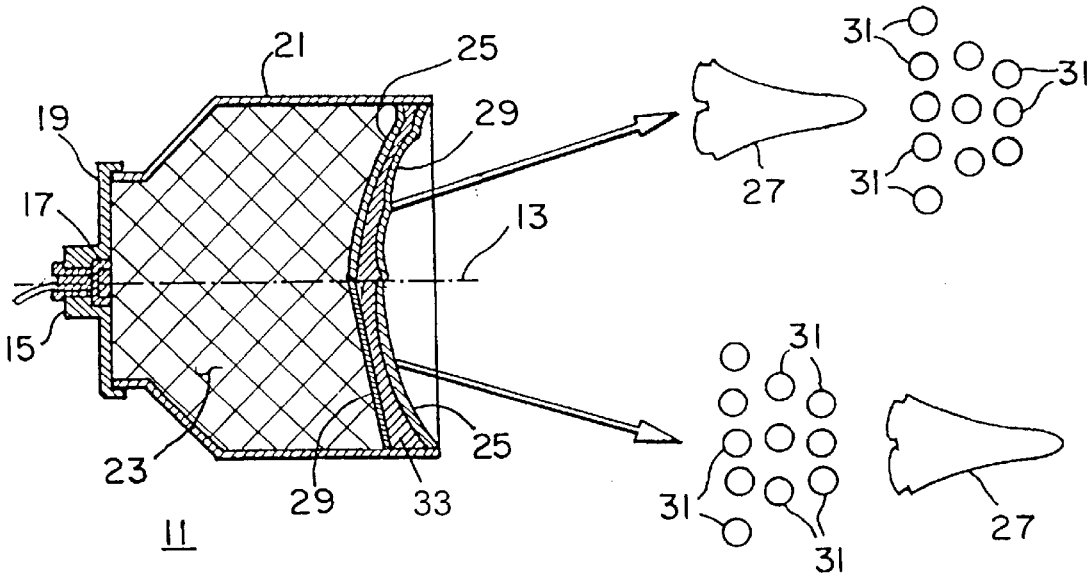
FIG. 3 is a schematic view of an alternative axisymmetric device showing a liner with a flat configuration.

In many instances, it is desirable to interpose an interface material 33 (FIG. 3) between the first and second liner, regardless of which liner comes first with respect to the axis. Interface material 33 may be formed from explosive materials (such as PBXN301) or from foam, rubber, plastic such as lexan, grease, or other materials. Thickness of interface material 33 may range from less that 0.80 inches to more than 0.360 inches, depending on munition design. The purpose of interface material 33 is to improve the relative velocity of the front and rear penetrators 27 and 31. Depending on which liner is axially forward of the other, different interface materials 33 may be employed to adjust the relative velocities of the two forms of penetrators. It should be noted that both configurations shown in FIG. 1 produce similar results. Side by side configurations present less risk since there will not be anything in front of the liners during formation. However, the tandem approach allows maximum use of the warhead diameter, resulting in a longer rod penetrator 27 and more multiple penetrators 31. The degree of liner separation depends on the interface material 33, of course. Tests showed that liners 25 and 29 were separated with an inert interface material by about 5 cm at about 300 microseconds and that distance remained the same up to more than 750 microseconds. Use of an explosive material caused a separation of 12.5 cm at about 280 microseconds and up to 35 cm at about 880 microseconds.

Because of the concern for proper liner fracture in the tandem or stacked configuration as shown alternatively in FIG. 1, a series of experiments was conducted to study the fracture mechanism of liner 27. Tests were made with hardware similar to FIG. 1, with the first liner 25 and interface material 33 missing so that the only variable is liner 27. A variety of liners were prepared according to Table I below, in which the upper and lower limits of liner thickness and curvature were covered.

TABLE I

LINER TESTS

| | subliner thickness, inches | | | | | |
|---|---|---|---|---|---|---|
| | tantalum | | | copper | | |
| Subliner curvature | 0.050 | 0.093 | 0.185 | 0.050 | 0.093 | 0.185 |
| low curve | x | ○ | ○ | x | ○ | ○ |
| medium curve | x | x | x | x | x | x |
| high curve | ○ | x | x | ○ | x | x |

A series of high speed photos aimed at the face of the test warheads of Table I were made as well as x-ray silhouettes. These photos showed that the liner started to fracture at about 19.8 microseconds and the x-ray view shows the multiple fragments were fully formed or deployed at about 400 microseconds.

As shown in FIG. 2, warhead 41 is a non-axisymmetrical combined effect warhead. This concept is applicable to a rectangular or square warhead housing. Warhead 41 has a first liner 43 in the center and a pair of second liners 45, which when detonated in the direction of the arrow produces an aerostable rod 47 and a plurality of fragments 49. These liners are enclosed in the warhead housing and placed on top of the explosive billet, not shown, in a manner similar to that shown in FIG. 1.

In summary, the present invention has been successfully demonstrated both in the axisymmetric and non-axisymmetric configurations. Results show the flexibility of designs with the ability to form long rod penetrators and multiple penetrators in both the stacked liner configuration and the side-by-side liner configuration. Test data shows that the present invention does defeat both armored and unarmored targets as intended.

While particular embodiments of the present invention have been illustrated and described herein, it is not intended that these illustrations and descriptions limit the invention. Changes and modifications may be made herein without departing from the scope and spirit of the following claims.

What is claimed is:

1. A combined effect warhead device for forming at least one aerostable rod fragment and a plurality of small fragments by explosive formation, comprising:

a warhead having a given diameter centered about an axis for containing explosives and liners, said warhead being deliverable in an axial direction toward a target;

a first liner adapted to form an aerostable rod; and a second liner adapted to form a plurality of fragments;

whereby detonation of said warhead produces combined explosively formed projectiles including said aerostable rod and said plurality of fragments.

2. The combined effect warhead device of claim 1, wherein said first liner is curved.

3. The combined effect warhead device of claim 1, wherein said second liner is substantially flat.

4. The combined effect warhead device of claim 3, wherein said second liner includes raised portions on its surface to facilitate formation of said plurality of fragments.

5. The combined effect warhead device of claim 1, which further includes an interface material between said first and said second liner.

6. The combined effect warhead device of claim 5, wherein said interface material is a combination of explosive material and plastic.

7. The combined effect warhead device of claim 1, wherein said first and second liners are placed in tandem in said warhead.

8. The combined effect warhead device of claim 7, wherein said first liner is axially above said second liner.

9. The combined effect warhead device of claim 7, wherein said second liner is axially above said first liner.

10. The combined effect warhead device of claim 1, wherein said first and second liners are placed side by side in said warhead.

11. The combined effect warhead device of claim 1, wherein said warhead is axisymmetric about its axis.

12. The combined effect warhead device of claim 1, wherein said warhead is non-axisymmetric about its axis.

13. A combined effect warhead device for forming at least one aerostable rod fragment and a plurality of small fragments by explosive formation, comprising:

a warhead having a given diameter centered about an axis for containing explosives and liners, said warhead being deliverable in an axial direction toward a target a first curved liner adapted to form an aerostable rod;

a second liner adapted to form a plurality of fragments, said second liner having raised portions on its surface to facilitate formation of said plurality of fragments;

said first and second liners being placed axially in tandem in said warhead; and an interface material between said first and second liners;

whereby detonation of said warhead produces combined explosively formed projectiles including said aerostable rod and said plurality of fragments.

14. The combined effect warhead device of claim 13, wherein said interface material is a combination of explosive material and plastic.

15. The combined effect warhead device of claim 13, wherein said warhead is axisymmetric about its axis.

16. The combined effect warhead device of claim 13, wherein said warhead is non-axisymmetric about its axis.

* * * * *